US006155571A

United States Patent [19]

Reinertsen

[11] Patent Number: 6,155,571

[45] Date of Patent: Dec. 5, 2000

[54] TOY ROTATING TARGET ASSEMBLY

[76] Inventor: Tormod K. Reinertsen, 197 Hornbine Rd., Rehoboth, Mass. 02769

[21] Appl. No.: 09/048,442

[22] Filed: Mar. 26, 1998

[51] Int. Cl.[7] ..... A63B 63/64

[52] U.S. Cl. ..... 273/390; 273/127 D

[58] Field of Search ..... 273/390, 391, 273/392, 127 D

[56] References Cited

U.S. PATENT DOCUMENTS

| | | | |
|---|---|---|---|
| 1,025,226 | 5/1912 | Wood . | |
| 1,615,924 | 2/1927 | Yancey . | |
| 2,085,933 | 7/1937 | Vaughan | 273/392 X |
| 2,185,055 | 12/1939 | Driscoll | 273/127 D |
| 3,430,959 | 3/1969 | Ross et al. | 273/127 D |
| 3,690,664 | 9/1972 | Hauke . | |
| 3,854,728 | 12/1974 | Brandell . | |
| 4,116,443 | 9/1978 | Dorfman . | |
| 4,322,082 | 3/1982 | Peters . | |
| 5,329,714 | 7/1994 | Lee . | |

FOREIGN PATENT DOCUMENTS 244168 12/1925 United Kingdom .

*Primary Examiner*—William H. Grieb

[57] ABSTRACT

A toy target game includes a plurality of targets rotatably mounted on a shaft. Each of the targets is mounted inside a sleeve which is also rotatably mounted on the shaft. Each target includes a depiction of a first character on a first end and a depiction of a second character on an opposite second end. Each target is mounted on the shaft through a transverse opening in the target at a midpoint of the target. Each sleeve is rectangular in cross-section and includes slots on opposing sides of the sleeve, through which the shaft passes. When the targets are aligned in a normal, vertical position, each sleeve covers the end of the target which is below the shaft, while leaving the end of the target which is above the shaft exposed. Each sleeve is slidable with respect to its associated target, such that, when a target is struck by an object, such as a ball which is rolled at the target, the target flips and the sleeve slides to cover the end which comes to rest under the shaft, thus covering that end and exposing the end which is above the shaft. The object of the game is to expose all of the ends of the targets which depict the same character by causing the targets to spin into the desired orientation by striking the targets with a rolled object.

12 Claims, 5 Drawing Sheets

TOY ROTATING TARGET ASSEMBLY

BACKGROUND AND SUMMARY OF THE INVENTION

The invention relates to a target game, and more particularly to a target assembly having a plurality of targets rotatably mounted on a shaft. When the target is struck by an object, such as a ball, the target rotates on the shaft causing a sleeve mounted on the target to slide from one end of the target to the other.

Target games, and in particular, rotating target games are well known in the art. In this regard, British patent document 244,168, and U.S. Pat. No. 1,025,226 to Wood, U.S Pat. No. 3,690,664 to Hauke and U.S. Pat. No. 4,116,443 to Dorfman are representative of the state of the prior art. British patent document 244,168 discloses a game in which rotatable targets are mounted on a shaft through slots in the targets, and a striker is directed at the targets in an attempt to flip the targets over. U.S. Pat. No. 3,690,664 discloses a bowling-style tic-tac-toe game having a number of targets rotatably mounted on a shaft through slots in the targets, each target including one end depicting an "X" and another end depicting an "O". The players roll a ball at the targets to flip the targets in an attempt to line all of the X's or O's along the top or bottom of the shaft. U.S. Pat. No. 4,116,443 discloses a pivoting target game having an array of rotating targets, each including a display element showing a particular character. An object is thrown at the targets in an attempt to rotate the targets into a specific alignment, such as in a tic-tac-toe game. While the above-noted games are each effective for their intended purpose, there is always an ongoing need and consumer desire for new games which have improved functionality.

The present invention provides a target game having a number of targets rotatably mounted on a shaft which is supported in spaced relation above a supporting surface. Each of the targets includes a sleeve of shorter length than the target which is slidably mounted on the target. More specifically, each target includes a depiction of a first character, or symbol, on a first end and a depiction of a second character or symbol on a second end, and each target is mounted on the shaft through a transverse opening in the target at a midpoint of the target. Each sleeve is rectangular in shape and includes slots on opposing sides of the sleeve, through which the shaft passes when the sleeve is mounted on the target. When the targets are aligned in a normal, vertical position, each sleeve covers the respective end of the target which is below the shaft, while leaving the opposing end of the target which is above the shaft exposed. Each sleeve is slidable with respect to its associated target, such that, when a target is struck by an object, such as a ball which is rolled at the target, the target rotates and the sleeve slides to cover the end which comes to rest under the shaft, thus covering that end and exposing the end which is above the shaft. The object of the game is to expose all of the ends of the targets which depict the same character by causing the targets to spin into the desired orientation by striking the targets with a rolled object such as a ball.

According to the preferred embodiment of the invention, a target assembly is disclosed, comprising a plurality of targets rotatably mounted on a shaft and a plurality of sleeves, each slidably mounted on a respective target. In a first orientation, a first half of each of the plurality of targets is exposed and a second half of each of the plurality of targets is concealed by one of said plurality of sleeves, and in a second orientation, the second half of each of the plurality of targets is exposed and the first half of each of the plurality of targets is concealed by one of the plurality of sleeves. More specifically, a target assembly is disclosed, comprising a shaft, a target having a first half and a second half interconnected by a central body, and a sleeve having first and second opposing major walls interconnected by first and second side walls, the first and second side walls having longitudinal slots. The sleeve is disposed around the target such that the shaft passes through both of the longitudinal slots of the sleeve and through the central body of said target. The slots allow the sleeve to slide relative to the shaft.

Accordingly, among the objects of the present invention are: the provision of a toy target assembly wherein a plurality of targets are rotatable around a shaft supported above a supporting surface; the provision of a target assembly wherein each of the targets includes a sliding sleeve which slides to cover selected portions of the target; the provision of a target assembly wherein when the targets are aligned in a normal, vertical position, each sleeve covers the respective end of the target which is below the shaft, while leaving the opposing end of the target which is above the shaft exposed; and the provision of such a target assembly wherein each sleeve is slidable with respect to its associated target, such that, when a target is struck by an object, such as a ball which is rolled at the target, the target rotates and the sleeve slides to cover the end which comes to rest under the shaft, thus covering that end and exposing the end which is above the shaft.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
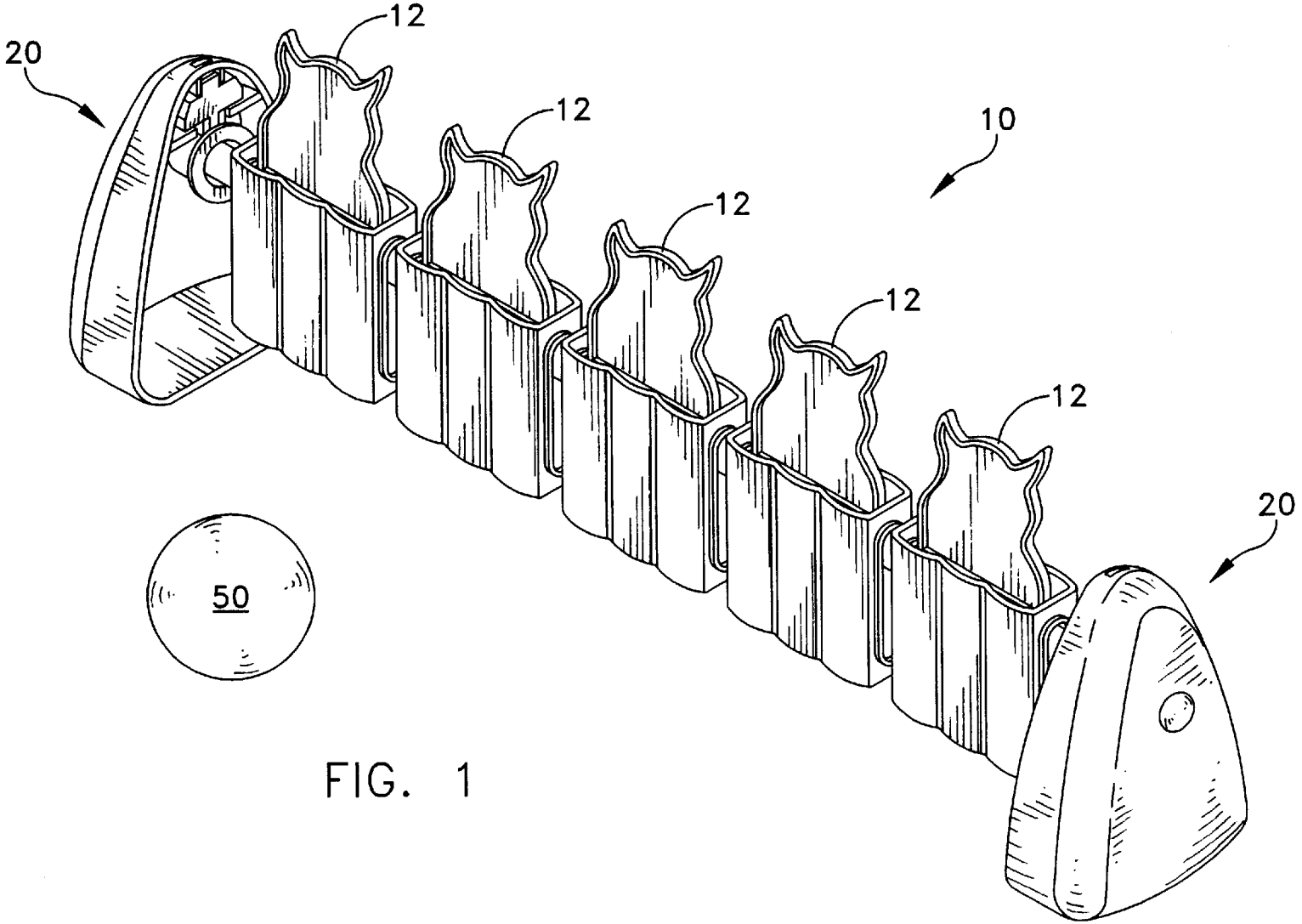
FIG. 1 is a perspective view of the target assembly of the present invention.

Referring now to the drawings, the target assembly of the present invention is illustrated and generally indicated at 10 in FIGS. 1–7. As will hereinafter be more fully described, the present target assembly 10 provides an amusing game for people of all ages. Unless otherwise indicated herein, it is to be understood that each of the structural elements described is preferably molded from a child-safe polymer material.

Figure 2:
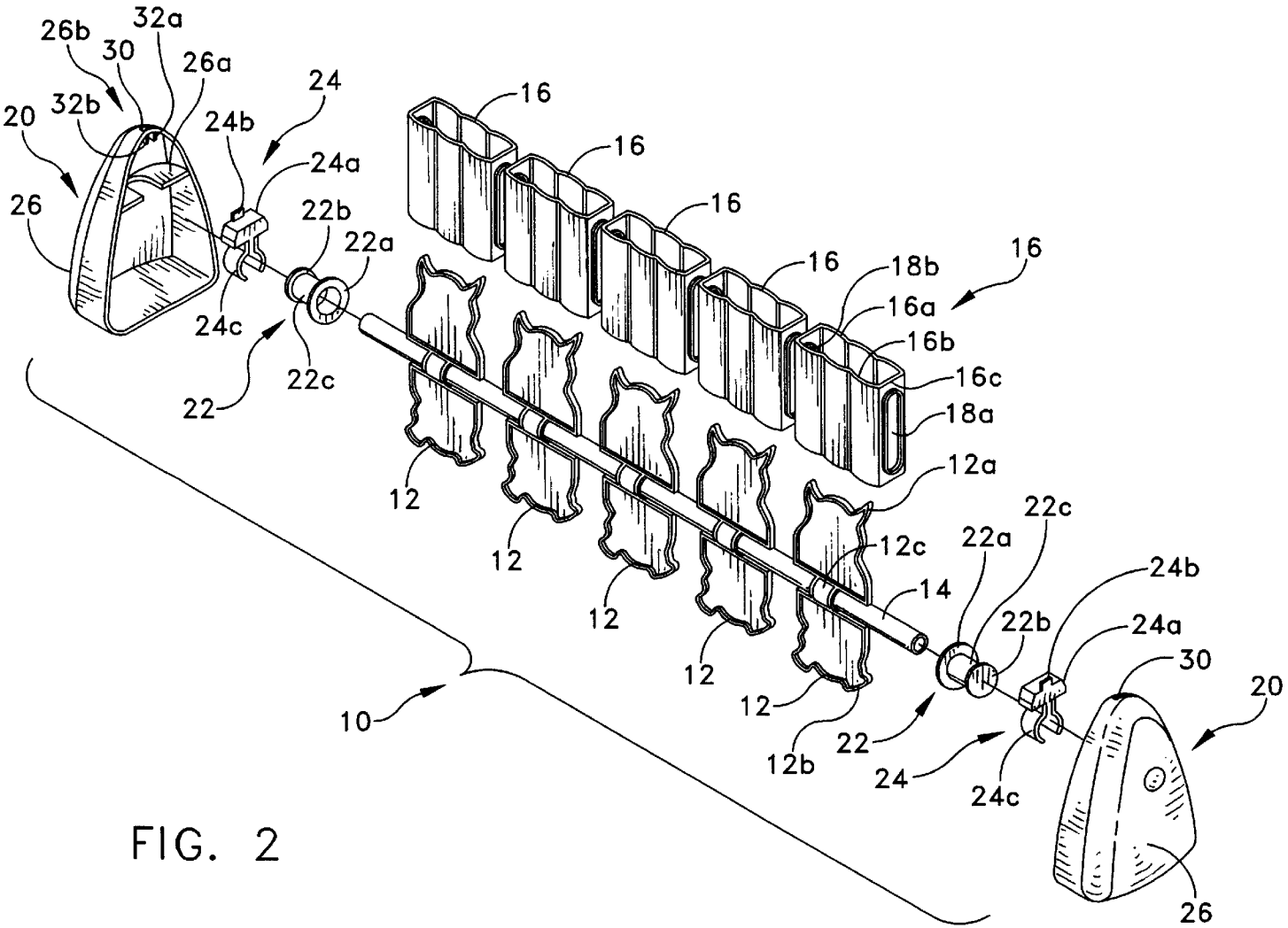
FIG. 2 is an exploded view of the target assembly of the present invention, showing all of the elements of the invention.
Figure 3:
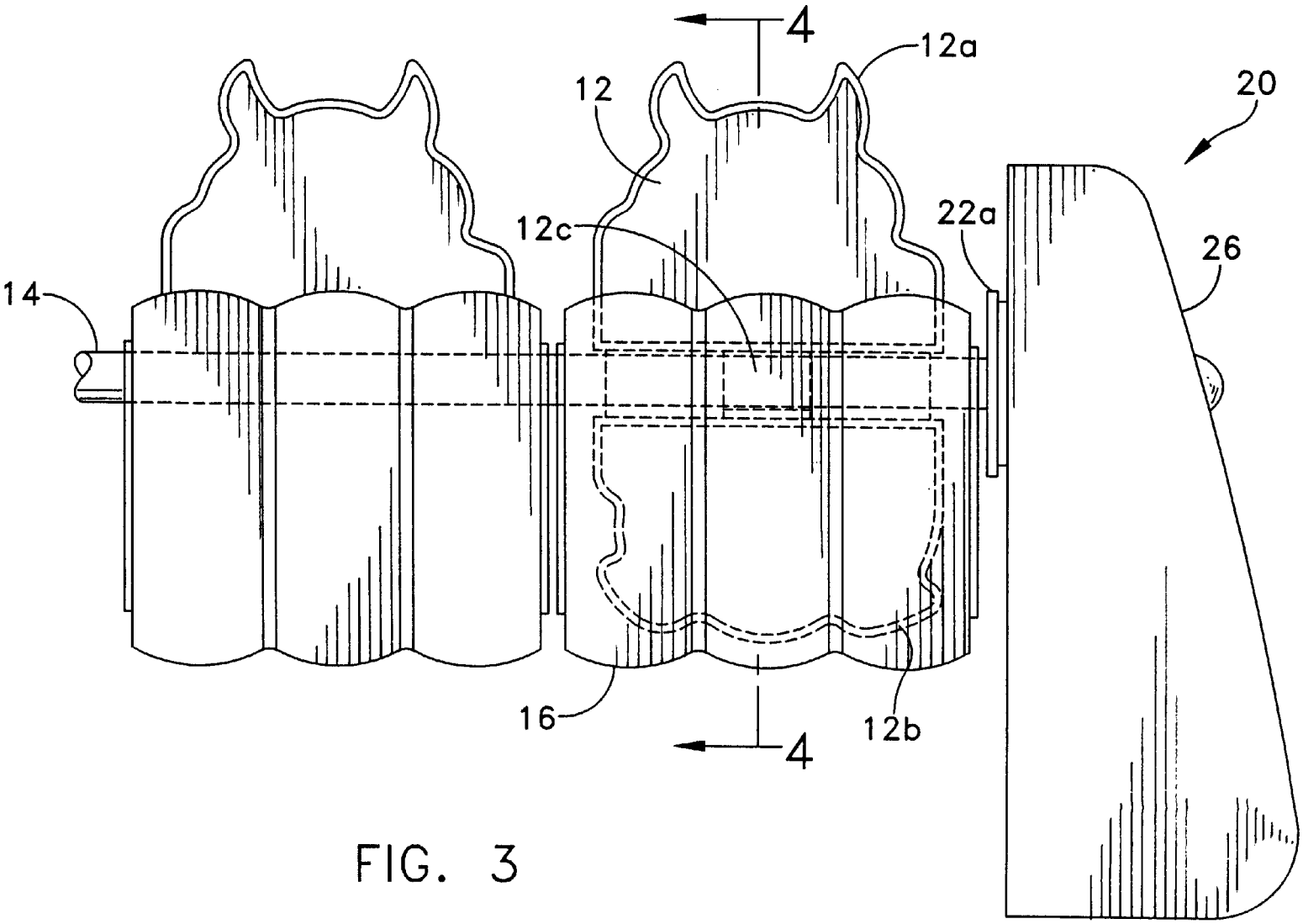
FIG. 3 is a partial front view of the target assembly of the present invention.
Figure 5:
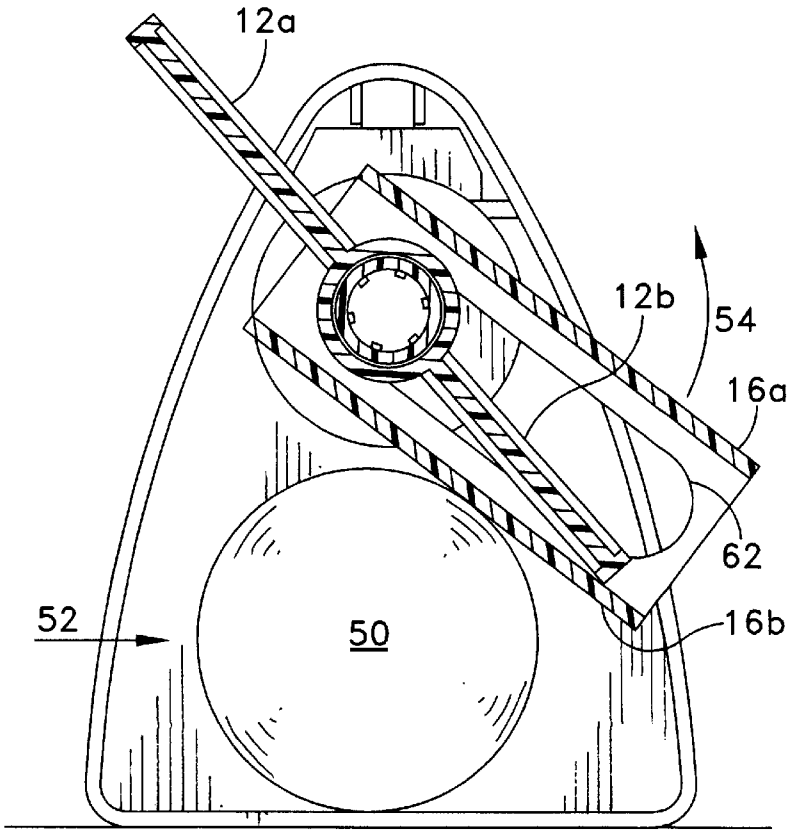
FIGS. 5–7 are cross-sectional views of the target assembly of the present invention, showing the movement of the sleeve as the target is rotated when struck by a ball.

As shown in FIGS. 1–3, the target assembly 10 comprises a plurality of targets generally indicated at 12 rotatably mounted on a shaft 14. Each of targets 12 includes a first half 12*a* and a second half 12*b*. First half 12*a* has a shape which resembles a first character, such as a cat and second half 12*b* has a shape which resembles a second character, such as a dog. Although not shown in the figures, halves 12*a* and 12*b* may have stickers applied to their surfaces to further enhance their appearances as a cat and a dog, respectively. Halves 12*a* and 12*b* are interconnected by a central body 12*c* having an inner diameter which is slightly larger than an outer diameter of shaft 14, to enable target 12 to freely rotate around shaft 14 when mounted thereon. It is to be understood that each end of the target could comprise any one of a number of different characters or symbols, the object being to match the same exposed end of each target 12.

The target assembly 10 further comprises a plurality of cover members, i.e. sleeves, 16 which preferably have a rectangular cross-section and include parallel walls 16*a* and 16*b* interconnected by parallel walls 16*c* and 16*d*. Walls 16*c* and 16*d* form the sides of the sleeve and each include a first longitudinal slot 18*a* in wall 16*c* and a second longitudinal slot 18*b* in wall 16*d*. Longitudinal slots 18*a* and 18*b* are centrally located in sides 16*c* and 16*d*, respectively, and are identical to each other in size, each having a height which is slightly less than the height of walls 16*c* and 16*d* and a width slightly greater than the outside diameter of shaft 14.

To mount each target 12 and sleeve 16 on shaft 14, each target 12 is placed inside each sleeve 16, central body 12*c* of each target 12 is aligned with slots 18*a* and 18*b* of each sleeve 16 and shaft 14 is inserted first through slot 18*a* of sleeve 16, then through central body 12*c* of target 12 and finally through slot 18*b* of sleeve 16. Each target 12 and sleeve 16 is mounted on shaft 14 in the same fashion. When mounted as described above, the natural weight of the sleeves 16 maintain the targets 12 in a generally vertical position and thus conceal half 12*b* (below the shaft 14) of targets 12, while allowing half 12*a* (above the shaft) to be exposed. Because sleeves 16 are rotatably and slidably mounted on shaft 14, this means that sleeves 16 are capable of rotating about shaft 14 along with their associated target 12 and also are capable of sliding across shaft 14 along the length of slots 18*a* and 18*b*.

Shaft 14 is mounted between opposing support assemblies 20, which operate to support the shaft 14, the targets 12 and the sleeves 16 above a supporting surface on which the support assemblies 20 are placed. Support assemblies 20 are identical in construction each including an end cap 22 having an inner flange 22*a*, an outer flange 22*b* and an intermediate section 22*c* disposed between inner flange 22*a* and outer flange 22*b*. Intermediate section 22*c* is cylindrical in shape and has an inner diameter slightly larger than the outer diameter of shaft 14 to enable end cap 22 to be mounted over the end of shaft 14 and to be held tightly in place by a friction fit.

Support assemblies 20 also each include a retainer 24, having a body portion 24*a*, a tab 24*b*, extending vertically upward from body portion 24*a*, and a C-shaped clip 24*c* extending vertically downward from body portion 24*a*. C-shaped clip 24*c* is clipped onto intermediate section 22*c* of end cap 22 to tightly engage the ends of shaft 14, thereby preventing shaft 14 from rotating.

Retainer 24 is mounted within support housing 26, which includes a shelf 26*a* and tab retainer 26*b*. Tab retainer 26*b* includes a slot 28 having a first nub 30*a* disposed on one side of slot 28 and a second nub 30*b* disposed on an opposite side of slot 30. Tab 24*b* is inserted in slot 30 of tab retainer 26*b*, between nubs 32*a* and 32*b*, and the bottom of body portion 24*a* is forcibly slid onto shelf 26*a*, to lock retainer 24 in place in support housing 26.

In its assembled form, as shown in FIG. 1, the targets 12 and sleeves 16 of the target assembly 10 are suspended above a floor surface (not shown) with enough clearance between targets 12 and sleeves 16 and the floor surface to enable targets 12 and sleeves 16 to freely rotate about shaft 14.

Figure 4:
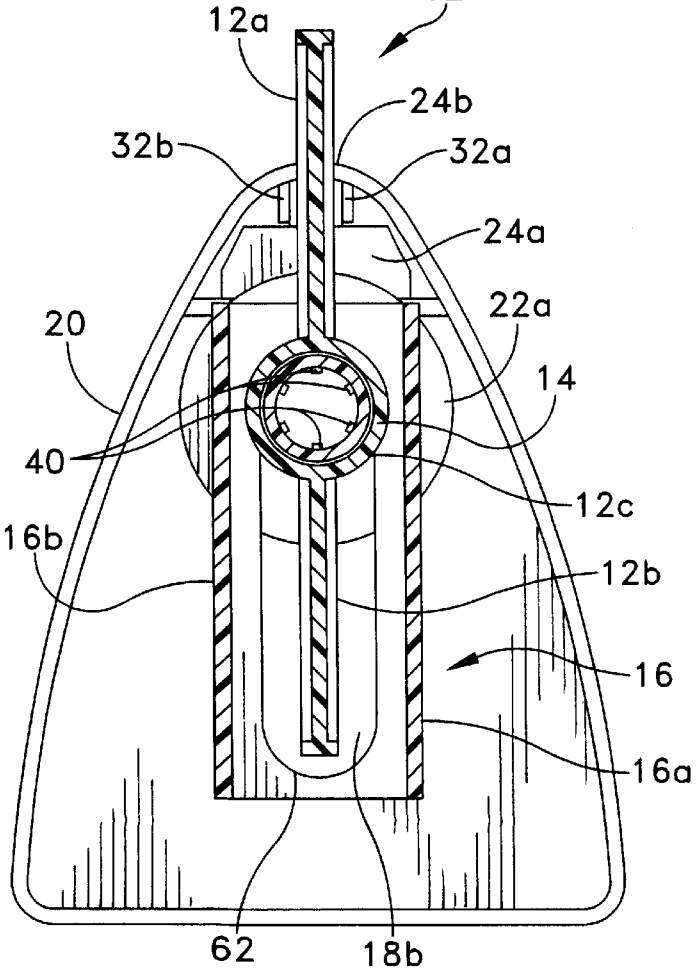
FIG. 4 is a cross-sectional view of the target assembly of the present invention, taken along line 4—4 of FIG. 3.

The operation of the target assembly 10 will now be described with reference to FIGS. 4–7, which show a cross-sectional view of the target assembly 10, taken along line 4—4 of FIG. 3. As shown in FIG. 4, in a resting state, sleeve 16 hangs vertically from shaft 14 by a first end 60 (not shown in FIG. 4) of slot 18*b*. Slot 18*b* also includes a second end 62, located opposite first end 60. Target 12 is also oriented in a vertical position. One half 12*b* of target 12 is covered by sleeve 16 while the other half 12*a* is exposed. Also shown in FIG. 4 are a number of longitudinal ribs 40 disposed on the inner surface of shaft 14 which act to strengthen shaft 14. To play the game associated with the present invention, a ball 50 is rolled toward the targets 12 of target assembly 10 in the direction indicated by arrow 52. Ball 50, which has a diameter small enough to allow ball 50 to pass under the shaft 14, contacts the target 12 and causes the target 12 to rotate about shaft 14 in the counterclockwise direction indicated by arrow 54.

Figure 7:
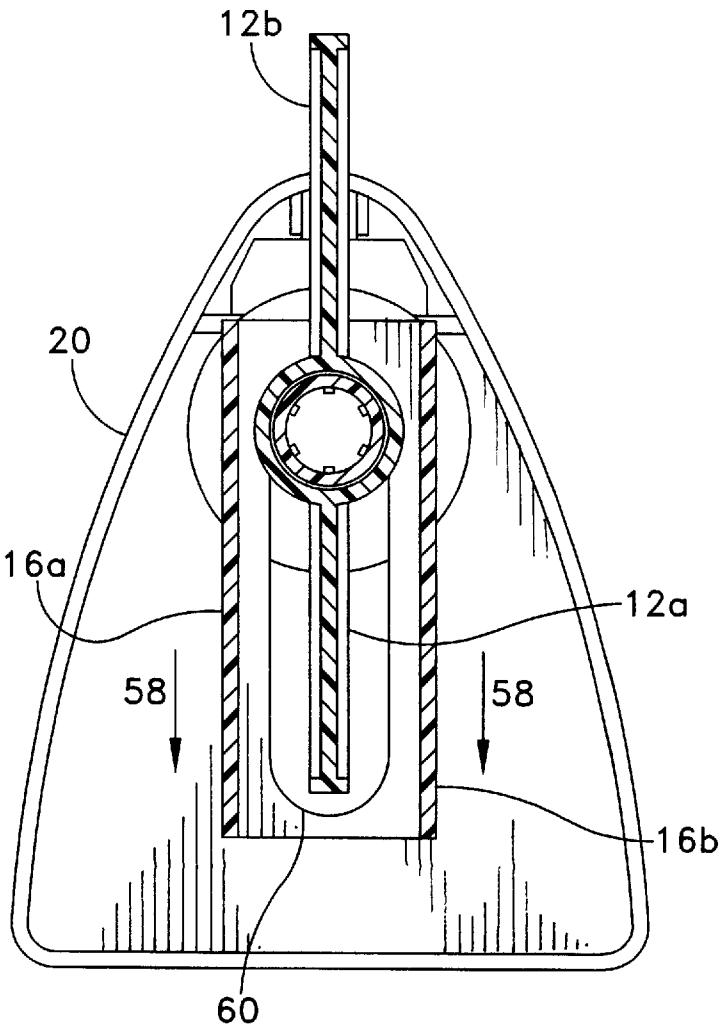
Figure 6:
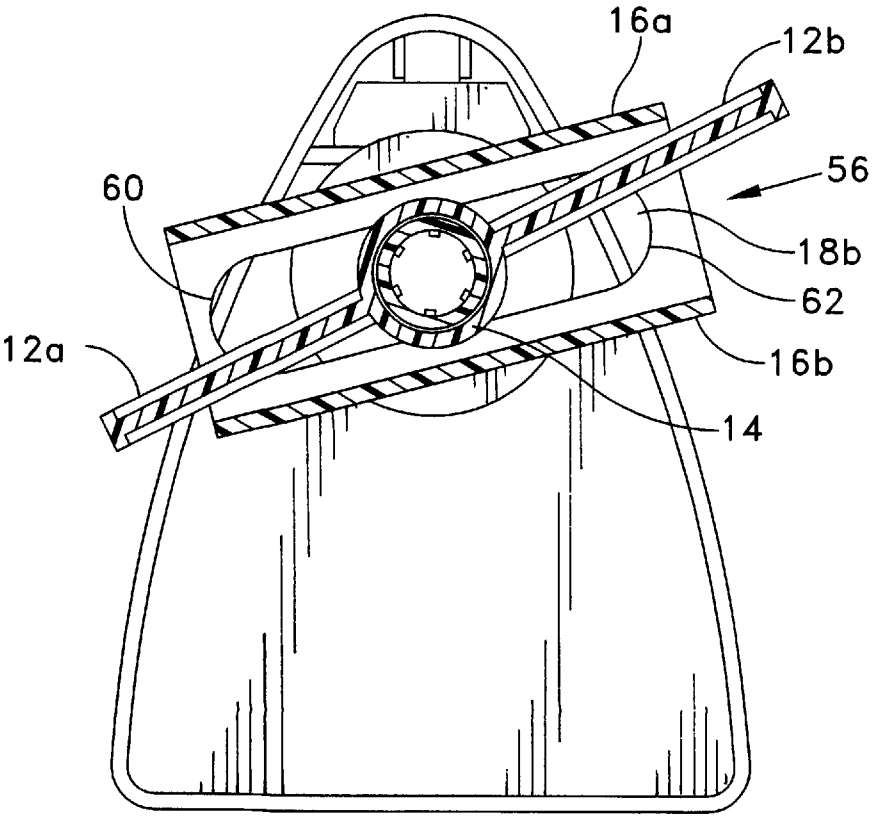

As shown in FIG. 6, as target 12 rotates in the counterclockwise direction, rotational forces and the force of gravity cause sleeve 16 to begin sliding downwardly along slot 18*b* and across shaft 14 in the direction indicated by arrow 56. As sleeve 16 slides along slot 18 across shaft 14, half 12*b* becomes more exposed, while half 12*a* becomes more concealed by sleeve 16. Finally, as shown in FIG. 7, sleeve 16 slides the remaining length of slot 18*b*, in the direction indicated by arrows 58, such that end 62 of slot 18*b* (not shown) comes to rest on shaft 14 and sleeve 16 and target 12 remain in the vertical position shown. However, because sleeve 16 slid along slot 18*b* and across shaft 14 and rotated 180°, and because target 12 also completed a 180° rotation, half 12*b* is now exposed above shaft 14 while half 12*a* is concealed within sleeve 16 below shaft 14.

When playing the game associated with the present invention, each player takes turns rolling the ball 50 at the target assembly in an effort to expose all of the players characters or symbols, which, as stated in the above description, may comprises, for example either a dog character or a cat character. The first player to succeed in exposing all of the target halves which depict his or her character wins the game. Variations of this theme may also played. For example, winning could be accomplished by the player who exposes a predetermined number of his or her character or who exposes a predetermined pattern of his or her character.

It can therefore be seen that the instant invention provides a simple and amusing game for children of varying ages which is effective for developing the motor skills of children. The rotating targets are easy to set up and assemble, and easy to move during play, thus giving the game a significant play value. Furthermore, the sliding sleeve members which cover selected portions of the targets provide additional play value as the hidden characters appear and disappear as the ball strikes various targets. For these reasons, the instant invention is believed to represent a significant advancement in the art which has substantial commercial merit.

While there is shown and described herein specific structure embodying the invention, it will be manifest to those skilled in the art that various modifications and rearrangements of the parts may be made without departing from the spirit and scope of the underlying inventive concept. For example, any number of targets and sleeves may be used, and any number of characters or other indicia may be included on the opposite halves of the targets. Accordingly, the underlying inventive concept is not limited to the particular forms herein shown and described except insofar as indicated by the scope of the appended claims.

What is claimed is:

1. A target assembly comprising:

a shaft;

means for supporting said shaft in spaced relation above a supporting surface;

a plurality of targets rotatably mounted on said shaft, each target having first and second opposing halves; and a plurality of sleeves each slidably mounted on an associated target, each of said targets being rotatable between a first orientation wherein said first half of said target is exposed and a second half of each of said plurality of targets is concealed by said associated sleeve, and a second orientation wherein said second half of said target is exposed and said first half of said target is concealed by one of said associated sleeve.

2. The target assembly of claim 1, wherein said first half of each of said plurality of targets depicts a first character and a second half of each of said plurality of targets depicts a second character.

3. The target assembly of claim 1, wherein means for supporting said shaft comprises a first support attached to a first end of said shaft and a second support attached to a second end of said shaft, said plurality of targets and said plurality of sleeves being suspended above said supporting surface between said first and second supports.

4. The target assembly of claim 3, further comprising means for contacting said plurality of targets to rotate said plurality of targets between said first orientation and said second orientation.

5. The target assembly of claim 4, wherein each of said plurality of sleeves has a pair of opposing major walls interconnected by a first and second opposing side walls, each of said side walls having a longitudinal slot therein, and wherein said first and second halves of each of said plurality of targets are interconnected by a central body, each one of said sleeves and targets being mounted on said shaft by inserting said shaft through said longitudinal slot of said first side wall of said sleeve, through said central body of an associated target and through said longitudinal slot of said second side wall of said sleeve, such that said sleeve hangs from said shaft from ends of said longitudinal slots.

6. The target assembly of claim 5, wherein, when one of said plurality of targets is rotated at least 180°, said associated sleeve slides along said longitudinal slots and across said shaft, until said first half of said target is concealed by said sleeve and said second half of said target is exposed.

7. A target assembly comprising:

a shaft;

means for supporting said shaft above a supporting surface;

a target having a first half and a second half interconnected by a central body; and a sleeve having first and second opposing major walls interconnected by first and second side walls, said first and second side walls having longitudinal slots therein, said shaft passing through said central body of said target, said sleeve being disposed on said target such that said shaft also passes through both of said longitudinal slots of said sleeve, said target being rotatable between a first orientation wherein said first half of said target is exposed and a second half of each of said plurality of targets is concealed by said associated sleeve, and a second orientation wherein said second half of said target is exposed and said first half of said target is concealed by said sleeve.

8. The target assembly of claim 7, wherein said first half of said target depicts a first character and said second half of said target depicts a second character.

9. The target assembly of claim 7, comprising a plurality of targets and sleeves mounted on said shaft.

10. The target assembly of claim 7, wherein said means for supporting said shaft is comprises first and second supports mounted to respective first and second ends of said shaft.

11. The target assembly of claim 7, further comprising means for contacting said target to rotate said target from said first orientation to said second orientation.

12. A toy target assembly comprising:

a shaft;

means for supporting the shaft in spaced relation above a supporting surface;

a plurality of targets each rotatably mounted on said shaft, said targets each being independently rotatable about said shaft, each target having a opposing first and second ends connected by a central body, said shaft passing through said central body; and a plurality a cover members each respectively slidably mounted on an associated target, said cover members being slidably movable along said target between a first position wherein said first end of said target is concealed by said cover member while said second end is exposed, and a second position wherein said second end of said target is concealed while said first end is exposed, each of said targets being rotatable on said shaft between a first orientation wherein said first end of said target is positioned below said shaft and the second end above the shaft, gravity causing said cover member to slide to said first position concealing said first end of said target and exposing said second end above the shaft, and a second orientation wherein said second end of said target is positioned below said shaft and the first end above the shaft, gravity causing said cover member to slide to said second position concealing said second end of said target and exposing said first end above the shaft.

* * * * *